United States Patent [19]

Bertelsen

[11] 4,002,007

[45] Jan. 11, 1977

[54] APPARATUS FOR CLOSING FLEXIBLE CONTAINERS

[76] Inventor: Robert C. Bertelsen, 42044 Balmoral Drive, Columbiana, Ohio 44408

[22] Filed: Apr. 16, 1976

[21] Appl. No.: 677,768

[52] U.S. Cl. ..... 53/138 A; 53/198 A

[51] Int. Cl.[2] ..... B65B 51/08; B65B 51/04; B65B 13/02

[58] Field of Search ..... 53/138 A, 198 A, 198 B, 53/378, 370

[56] References Cited

UNITED STATES PATENTS

| | | | |
|---|---|---|---|
| 3,293,736 | 12/1966 | Tipper | 53/138 A |
| 3,380,226 | 4/1968 | Tracy | 53/138 A |
| 3,455,010 | 7/1969 | Busler | 53/138 A |
| 3,717,972 | 2/1973 | Niedecker | 53/138 A |

*Primary Examiner*—Travis S. McGehee
*Assistant Examiner*—Horace M. Culver

[57] ABSTRACT

Disclosed is an apparatus for closing open-topped flexible containers, the apparatus being of the type having a pair of movable gathering arms which can gather and compress the flexible material to a configuration, and at an appropriate location, suitable for applying a fastener to the gathered material. The gathering arms cooperate with fixed guide means to sweep the flexible material to the gathered location. The gathering arms and the guide means are shaped, and positioned relative to one another, such that, at each location in the motion of the gathering arms, they make at least a right angle with respect to both the adjacent guide means and each other, thereby reducing the possibility of damaging shearing action on the flexible material.

7 Claims, 5 Drawing Figures

APPARATUS FOR CLOSING FLEXIBLE CONTAINERS

BACKGROUND OF THE INVENTION

This invention relates to apparatus for closing containers formed from a flexible material, such as plastic bags. With the widespread usage of such containers for handling a wide variety of materials, various machines have been proposed to eliminate the necessity of hand sealing of the containers. Such machines have typically employed a pair of gathering arms movable between an open position and a closed position in which the flexible material of the container is gathered and compressed. With the flexible material in that gathered and compressed condition, a sealing device (a device for applying a staple, a wire twist, etc.) is actuated to firmly seal the container. Examples of such devices can be found in Neidecker U.S. Pat. No. 3,717,872; Tipper U.S. Pat. No. 3,293,736; and Russel et al, U.S. Pat. No. 2,733,442.

Experience has proven, however, that it is not always easy to rapidly feed containers to such machines and the machines have often caused damage to the container material, especially when it was relatively thin. Additionally, some machines themselves had a relatively short usable lifetime when used for sealing flexible containers used to package an abrasive material.

OBJECTS AND SUMMARY OF THE INVENTION

In view of the above discussion, it is a principal object of the present invention to provide a machine for closing a flexible container which overcomes the problems discussed above.

In accordance with the present invention, apparatus for closing an open-ended container formed from a flexible material comprises fixed guide means, movable gathering arms, drive means for those arms, and fastening means for applying a closure device to the gathered material. The fixed guide means define an opensided channel for receiving flexible material and include a pair of planar portions each having a guide edge. Each gathering arm is supported for motion in a plane parallel to an adjacent guide means planar portion and each includes a material contacting edge which, during movement of the arm between a first, open position retracted from the associated guide edge and a second, closed position, in which it makes at least a right angle with the associated guide edge and also with the analogous edge of the other gathering arm. With this arrangement, shearing action with respect to the flexible container material is avoided by the machine parts that contact the material. Additionally, the fully retracted arms facilitate rapid and convenient feeding of containers.

Preferably, each gathering arm has a material-contacting edge having a concave curvature; the guide means include guide edges having a convexly curved region adjacent the location to which the container material is gathered; and the apparatus includes two sets of arms and of guide means, thereby facilitating the sealing of the container with a closure device intermediate those two sets.

BRIEF DESCRIPTION OF THE DRAWINGS

Other objects, features, and advantages will appear from the following description of particular embodiment, taken together with the accompanying drawings, in which.

DETAILED DESCRIPTION OF A PARTICULAR PREFERRED EMBODIMENT

Figure 1:
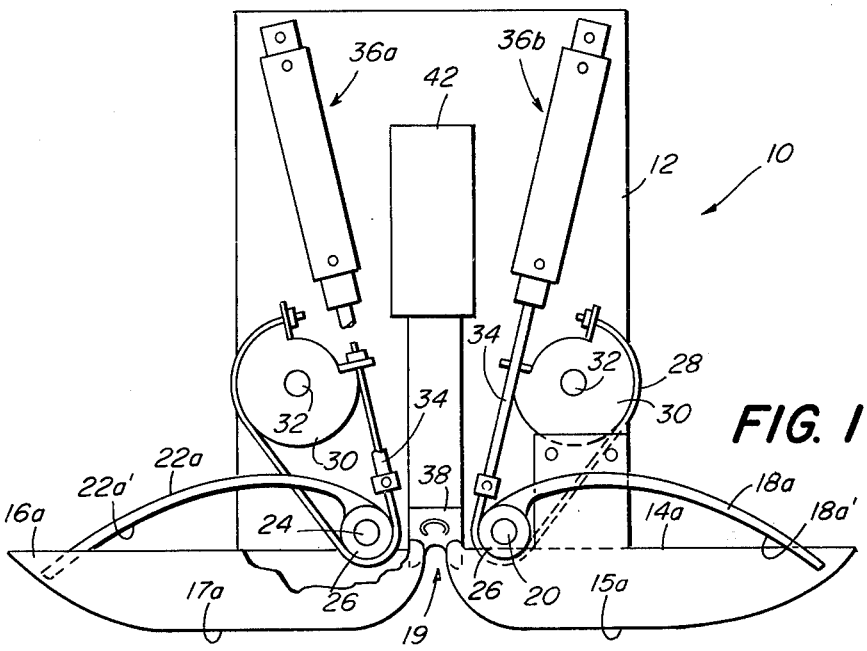
FIG. 1 is a plan view of apparatus constructed in accordance with the present invention.
Figure 2:
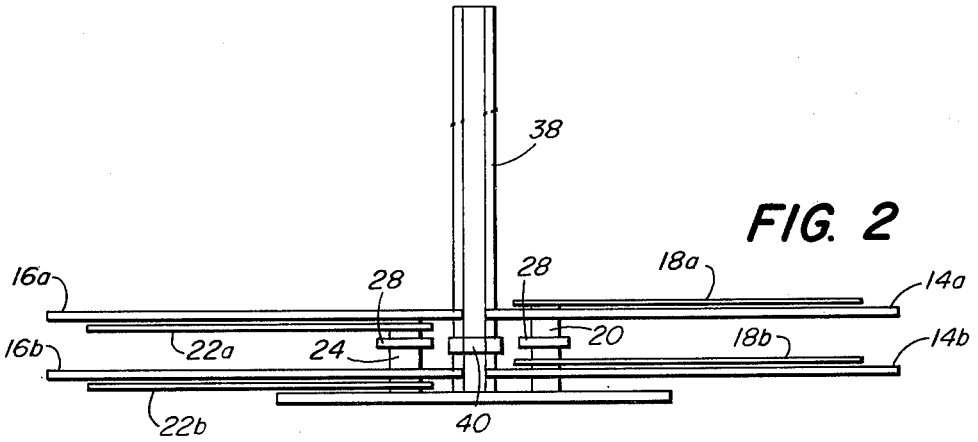
FIG. 2 is a front elevation of the apparatus of FIG. 1.

Referring to FIGS. 1 and 2, the apparatus 10 includes a base 12, a first set of upper planar guide plates 14*a*, 16*a*, and an aligned set of lower guide plates 14*b*, 16*b*. Forward-facing guide edges of the various guide plates (e.g., edges 15*a* and 17*a* of plates 14*a* and 16*a*) are convexly curved at a central portion of the machine, thereby defining an open-sided channel 19 in which flexible material of a container can be gathered and compressed.

A pair of gathering arms 18*a*, 18*b* are supported for rotation with a shaft 20 and are disposed to be parallel to, and slightly spaced apart from the upper surfaces of, the guide plates 14*a*, 14*b*, respectively. Similarly, gathering arms 22*a*, 22*b* are supported for rotation with a shaft 24 and are parallel to, and slightly spaced apart from the lower surface of, the guide plates 16*a*, 16*b*, respectively, Each of the four gathering arms has concavely curved, material-contacting edge extending from near the respective shaft 20, 24 to the free end of the gathering arm. In FIG. 1, the material-contacting edges of arms 18*a* and 22*a* are indicated at 18*a*′ and 22*a*′, respectively.

Each of the arm is secured to the respective shaft 20, 24, by a base or hub of the arm. The shafts 20, 24 are supported for rotation with respect to the base 12. Chains 28 engage sprockets (not visible in the drawings) and are also trained about the sprockets 30 supported for rotation with respect to shafts 32, also secured to the base 12. The chains 28 are driven by piston rods 34 which are connected to the chains and which are driven by pistons of double-acting air cylinders 36*a* and 36*b*.

The structure just described operates, as explained in detail below, to gather and compress the material of an open-ended container. Actual sealing of the container is accomplished, in a conventional fashion, by a clinching device supported on the base 12 and including a magazine 38 for holding a supply of fastening devices (e.g., "hog rings"), a clinching head 40 that clinches the fastening devices presented to it by the magazine 38 around the gathered flexible material; and a drive unit 42, typically air-operated, that operates the clinching head 40. The details of the unit formed from items 38, 40 and 42 are conventional and form no part of the present invention.

Figure 4:
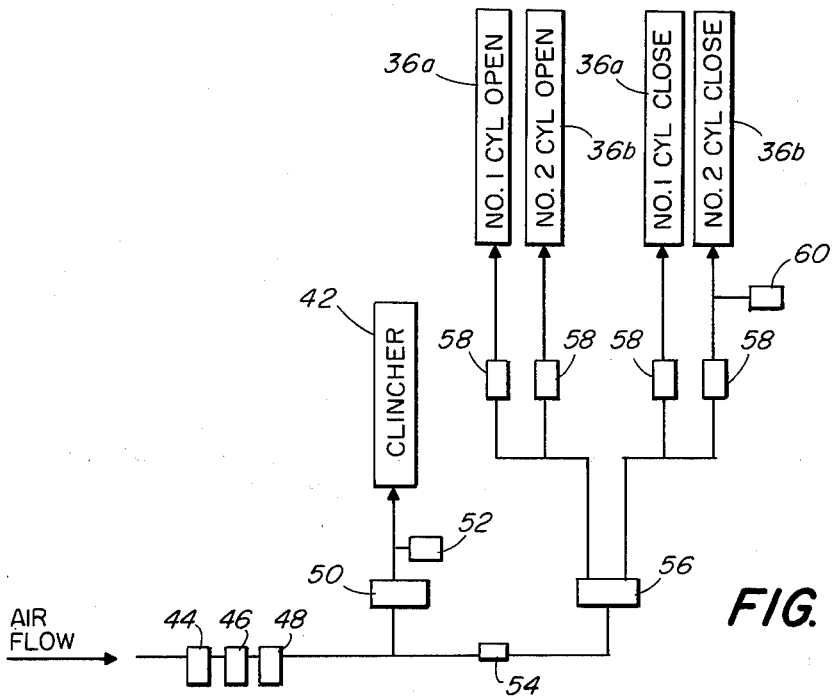
FIG. 4 is a schematic diagram of an air system for the machine of FIG. 1.

The air system for operating the double-acting cylinders 36a and 36b and the drive unit 42 can be described with reference to FIG. 4. Air is supplied to the apparatus from a source of compressed air through an air cleaner 44, a regulator 46 and an oiler 48. Downstream from the oiler 48, the air line branches to provide separate supply lines for the clincher drive unit 42 and the double acting cylinders 36*a* and 36*b*, which drive the gathering arms. A solenoid valve 50 controls the delivery of air to the clincher drive unit 42 and is, itself, controlled in a manner described in detail below. A normally closed, pressure rise switch 52 also communicates with the line to the clincher downstream of the valves 50.

The other conduit for compressed air leads to the double acting cylinders through a check valve 54, a solenoid valve 56, and separate, adjustable flow controllers 58 for each of the four lines leading to the double-acting cylinders. A normally open pressure rise switch 60 communicates with one of the "cylinder-close" air lines downstream from the respective flow controller 58.

Figure 5:
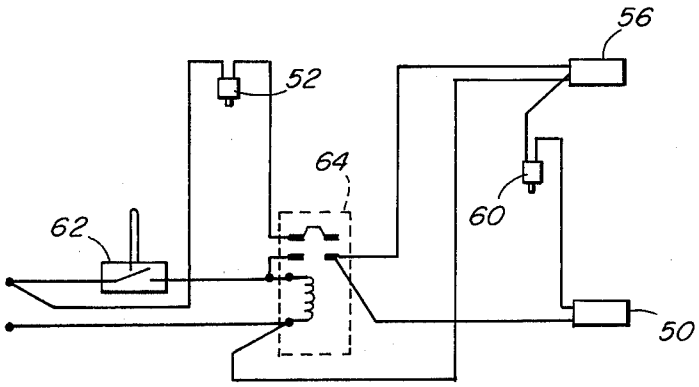
FIG. 5 is a schematic diagram of an electrical system for the machine of FIG. 1.

The electrical schematic of FIG. 5 illustrates the control of the clincher solenoid valve 50 and the double-acting cylinder solenoid valve 56. A normally open, momentary operating switch 62 controls the flow of line current to a relay 64 that is connected to actuate the solenoid valve 56.

In operation, a machine operator sets a suitable container (e.g., an open-topped flexible bag) on a platform (not shown) with the open end of the flexible bag material disposed generally in the channel 19. As will be evident to those skilled in the art, because of the foolproof feeding of containers to the device and its rapid operation, containers could be delivered to the device automatically (e.g., on a conveyor). Momentary pressure on the normally open operating switch 62 activates the relay 64 which, in turn, operates the cylinder solenoid valve 56. The valve 56 then switches the air pressure from the line feeding the cylinder-open lines to the line feeding the cylinder-close lines resulting in air pressure within the cylinders forcing the pistons to drive the piston rods inwardly toward the cylinders 36 (i.e., generally upwardly as viewed in FIG. 1). Through the linkages of the chains 28 and the spockets (not shown) secured to the shafts 20, 24, the linear movement of the piston rods 34 causes rotation of the arms 18*a*, 18*b* in a clock-wise sense (viewed in FIG. 1) and of the arms 22*a* and 22*b* in a counter-clockwise sense. Successive stages of the motion of these arms is illustrated in the schematic diagram of FIG. 3 as positions I-V. As will be evident to those skilled in the art, the area enclosed between the moving arms and the adjacent guide edges (e.g., 15*a*, 17*a*) of the guide plates, becomes successively smaller as the arms rotate, thereby gathering and capturing the bag and compressing its flexible material. As is evident from FIG. 1, in their initial positions the gathering arms are fully retracted from the associated guide edges (e.e., 15*a* and 17*a*). This arrangement provides an uobstructed entrance into the channel 19 and thereby facilitates the feeding of bags to the apparatus. Furthermore, since the flexible material of the bags typically "blossom" after the operator has placed them in the channel 19 and released them prior to actuation of the apparatus, the retracted initial position of the arms and their wide, capturing-type swing (see FIG. 3) prevents material of the bag from escaping the sweep of the arms to be pinched or torn as the arms tips approach each other. Furthermore, as will be understood by those skilled in the art, the force required to further gather or compress the material of a bag increases as the degree of compression increases. With the arrangement of the present apparatus, as can be understood from FIG. 3, the location along the gathering arms at which force is applied to the material of the bag becomes closer to the shafts 20, thereby shortening the moment arm, as the compression increases. This arrangement thereby can provide increased bag compression for a given degree of force exerted by the apparatus or, alternatively, greater bag compression for a given degree of applied force, that has been possible with various prior art arrangements.

When the arms are fully closed, the air pressure in the line feeding the cylinders will rise to the line pressure, thereby activating the cylinder pressure rise switch 60. As is evident from FIG. 5, the closing of cylinder pressure rise switch 60 results in the clincher solenoid valve 50 being actuated. Air pressure is then delivered to the clincher drive unit 42 and the clinching heat 40 operates in a conventional manner to secure the fastening device around the gathered flexible material of the bag. When this is completed at the full stroke of a conventional piston within the unit 42, the air pressure and the clincher feed line will rise, thereby activating the clincher pressure rise switch 52. As is evident from FIG. 5, this results in the circuit being broken, thereby permitting the cylinder solenoid valve 56 to return to its original configuration, thereby driving the gathering arms to their original, or open, position. Meanwhile, the clincher solenoid valve 50 returns to its exhaust condition, thereby permitting the clinching unit to return to its original configuration.

Figure 3:
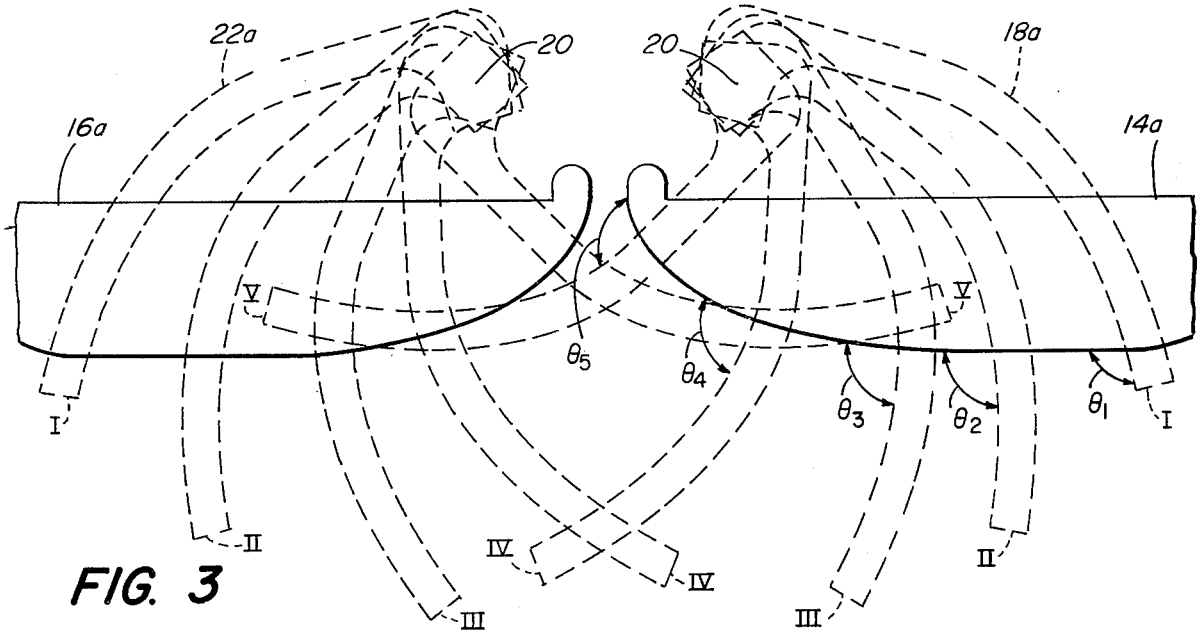
FIG. 3 is a schematic illustration demonstrating the operation of the machine of FIGS. 1 and 2.

Referring now to the schematic illustration of FIG. 3, it will be seen that, with the illustrated configuration of the material-contacting edges of the gathering arms and of the guide edges of the guide plates, the angle between the material-contacting edges and the associated guide edges is an obtuse angle at all positions of the gathering arms. This is illustrated in Fig. 3 for arm 18*a* where this obtuse angle is indicated for each illustrated position of the arm at $\Lambda_1$ through $\Lambda_5$. As is also evident from FIG. 3, at all positions where arms 18*a*, 22*a* overlap, the angle between the arms is also an obtuse angle. This arrangement reduces the danger of a shearing or cutting of the flexible material of the bag during the gathering operation. Additionally, it will be evident from the above description of a machine constructed in accordance with the present invention that there is no sliding friction between parts of the machine during the gathering operation. This, of course, not only eliminates wear in normal usage, but is highly desirable where the machine is used in an abrasive environment.

While a particular preferred embodiment of the present invention has been illustrated in the accompanying drawings and described in detail herein, other embodiments are within the scope of the invention and the following claims. Illustrative of such other embodiments are those in which there are less than four gathering arms. For example, referring to FIG. 2, for use with various types of flexible material containers and various types of clinching devices, a single pair of arms may be suitable (e.g., arms 18*a* and 22*a*; etc.).

I claim:

1. Apparatus for closing an open-sided container formed from a flexible material comprising fixed guide defining an open-sided channel for receiving flexible material of a container and including first and second planar portions, each having a guide edge, first and second gathering arms supported for motion in planes parallel to, respectively, said first and second planar portions of said guide means, each gathering arm including a material contacting edge and being movable between a first open position in which said first and second arms are retracted from the associated guide edges and a second position in which said first and second arms overlap the associated guide edges and each other to enclose the open side of said channel defined by said guide means, thereby to gather portions of said flexible material intermediate said arms, each said material contacting edge shaped, such that it makes at least a right angle with its associated guide edge and also with the other material contacting edge throughout the movement of the arm between said first and second positions, drive means for driving said arms between said portions, and fastening means applying a closure device to said gathered material portions when said first and second arms are in their second positions.

2. The apparatus of claim 1 wherein each said arm is supported for rotation about an axis perpendicular to said guide means planar portions.

3. The apparatus of claim 2 wherein each said material contacting edge has a concave curvature.

4. The apparatus of claim 3 wherein each said guide edge includes a convexly curved region adjacent said open-sided channel.

5. The apparatus of claim 2 further including second fixed guide means of like construction as said first mentioned guide means and third and fourth gathering arms related with respect to said second fixed guide means as said first and second arms are related to said first mentioned guide means, said first and third arms being coaxial and said second and fourth arms being coaxial.

6. The apparatus of claim 5 wherein said fastening means are disposed to apply said closure device intermediate said first and third arms and intermediate said second and fourth arms.

7. The apparatus of claim 1 wherein said guide means planar portions are co-planar with each other, said first gathering arm being disposed on one side of said planar portions and said second gathering arm being disposed on the other side of said planar portions, each said arm being spaced apart from the adjacent surface of said guide means, whereby the movement of said arms is free of contact between either arm and the guide means and between the two arms themselves.

* * * * *

UNITED STATES PATENT AND TRADEMARK OFFICE

CERTIFICATE OF CORRECTION

PATENT NO. : 4,002,007

DATED : January 11, 1977

INVENTOR(S) : Robert C. Bertelsen

It is certified that error appears in the above-identified patent and that said Letters Patent are hereby corrected as shown below:

Column 1, line 19: change "3,717,872" to --3,717,972--

Column 1, line 41: change "opensided" to --open-sided--

Column 2, line 31: insert --a-- before "concavely"

Column 2, line 37: change "arm" to --arms--

Column 2, line 38: insert --26-- before "of"

Column 3, line 10: insert --two-- before "double-acting"

Column 3, line 50: change "e.e." to --i.e.--

Column 4, line 28: change "configuration" to --configurations--

Column 4, line 35: change "$\Lambda_1$ through $\Lambda_5$" to --$\theta_1$ through $\theta_5$--

Column 4, line 61: insert --means-- before "defining"

Column 5, line 12: change "arm" to --arms--

UNITED STATES PATENT OFFICE

CERTIFICATE OF CORRECTION

Patent No. 4,002,007 Dated January 11, 1977

Inventor(s) Robert C. Bertelsen

It is certified that error appears in the above-identified patent and that said Letters Patent are hereby corrected as shown below:

Column 5, line 16, insert -- for -- before "applying".

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*